US006808415B1

(12) United States Patent
Montena

(10) Patent No.: US 6,808,415 B1
(45) Date of Patent: Oct. 26, 2004

(54) CLAMPING AND SEALING MECHANISM WITH MULTIPLE RINGS FOR CABLE CONNECTOR

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/764,782

(22) Filed: Jan. 26, 2004

(51) Int. Cl.[7] ..... H01R 9/05
(52) U.S. Cl. ..... 439/584
(58) Field of Search ..... 439/578, 583, 439/584, 585

(56) References Cited

U.S. PATENT DOCUMENTS

| | | | |
|---|---|---|---|
| 2,258,737 | A | 10/1941 | Browne |
| 2,785,384 | A | 3/1957 | Wickesser |
| 3,022,482 | A | 2/1962 | Waterfield et al. |
| 3,076,169 | A | 1/1963 | Blaisdell |
| 3,184,706 | A | 5/1965 | Atkins |
| 3,275,913 | A | 9/1966 | Blanchard |
| 3,355,698 | A | 11/1967 | Keller |
| 3,406,373 | A | 10/1968 | Forney, Jr. |
| 3,498,647 | A | 3/1970 | Schroder |
| 3,581,269 | A | 5/1971 | Frey et al. |
| 3,629,792 | A | 12/1971 | Dorrell |
| 3,671,922 | A | 6/1972 | Zerlin et al. |
| 3,671,926 | A | 6/1972 | Nepovim |
| 3,686,623 | A | 8/1972 | Nijman |
| 3,710,005 | A | 1/1973 | French |
| 3,744,011 | A | 7/1973 | Blanchenot |
| 3,757,279 | A | 9/1973 | Winston |
| 3,845,453 | A | 10/1974 | Hemmer |
| 3,915,539 | A | 10/1975 | Collins |
| 3,936,132 | A | 2/1976 | Hutter |
| 3,985,418 | A | 10/1976 | Spinner |
| 4,046,451 | A | 9/1977 | Juds et al. |
| 4,053,200 | A | 10/1977 | Pugner |
| 4,059,330 | A | 11/1977 | Shirey |
| 4,126,372 | A | 11/1978 | Hashimoto et al. |
| 4,156,554 | A | 5/1979 | Aujla |
| 4,168,921 | A | 9/1979 | Blanchard |
| 4,173,385 | A | 11/1979 | Fenn et al. |
| 4,227,765 | A | 10/1980 | Neumann et al. |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward |
| 4,408,821 | A | 10/1983 | Forney, Jr. |
| 4,408,822 | A | 10/1983 | Nikitas |
| 4,421,377 | A | 12/1983 | Spinner |

(List continued on next page.)

FOREIGN PATENT DOCUMENTS

| | | |
|---|---|---|
| DE | 1 191 880 | 4/1954 |
| EP | 0 265 276 | 4/1988 |
| GB | 1087 228 | 10/1967 |
| GB | 1270 846 | 4/1972 |
| GB | 2019 665 | 10/1979 |
| GB | 2079 549 A | 1/1982 |

*Primary Examiner*—Thanh-Tam Le
(74) *Attorney, Agent, or Firm*—Wall Marjama & Bilinski LLP

(57) ABSTRACT

A two-piece cable connector includes a connector body and a threaded nut or compression fitting that attaches at a first end of the connector body. Two series of rings are interleaved with tapered sides adjacent each other, with the rings being fitted inside the connector body outside a portion of a mandrel. Two plastic rings are fitted adjacent the series of rings at the first end of the connector body. The threaded nut or compression fitting drives the plastic rings against each other and the inboard ring against the series of rings in wedging engagement, thus creating an interference fit among the grounded connector body, the series of rings, a ground sheath of a coaxial cable, and the mandrel. The two plastic rings from a seal protecting the inside of the cable connector from the environment.

29 Claims, 15 Drawing Sheets

U.S. PATENT DOCUMENTS 4,444,453 A 4/1984 Kirby et al.
4,484,792 A 11/1984 Tengler et al.
4,533,191 A 8/1985 Blackwood
4,545,637 A 10/1985 Bosshard et al.
4,557,546 A 12/1985 Dreyer
4,575,274 A 3/1986 Hayward
4,583,811 A 4/1986 McMills
4,596,435 A 6/1986 Bickford
4,600,263 A 7/1986 DeChamp et al.
4,614,390 A 9/1986 Baker
4,645,281 A 2/1987 Burger
4,650,228 A 3/1987 McMills et al.
4,655,159 A 4/1987 McMills
4,660,921 A 4/1987 Hauver
4,668,043 A 5/1987 Saba et al.
4,674,818 A 6/1987 McMills et al.
4,676,577 A 6/1987 Szegda
4,684,201 A 8/1987 Hutter
4,691,976 A 9/1987 Cowen
4,738,009 A 4/1988 Down
4,746,305 A 5/1988 Nomura
4,747,786 A 5/1988 Hayashi et al.
4,755,152 A 7/1988 Elliot et al.
4,789,355 A 12/1988 Lee
4,806,116 A 2/1989 Ackerman
4,813,886 A 3/1989 Roos et al.
4,824,401 A 4/1989 Spinner
4,834,675 A 5/1989 Samchisen
4,854,893 A 8/1989 Morris
4,857,014 A 8/1989 Alf et al.
4,869,679 A 9/1989 Szegda
4,892,275 A 1/1990 Szegda
4,902,246 A 2/1990 Samchisen
4,906,207 A 3/1990 Banning et al.
4,923,412 A 5/1990 Morris
4,925,403 A 5/1990 Zorzy
4,929,188 A 5/1990 Lionetto et al.
4,973,265 A 11/1990 Heeren
4,990,104 A 2/1991 Schieferly
4,990,105 A 2/1991 Karlovich
4,990,106 A 2/1991 Szegda
5,002,503 A 3/1991 Campbell et al.
5,011,432 A 4/1991 Sucht et al.
5,021,010 A 6/1991 Wright
5,024,606 A 6/1991 Ming-Hwa
5,037,328 A 8/1991 Karlovich
5,062,804 A 11/1991 Jamet et al.
5,066,248 A 11/1991 Gaver
5,073,129 A 12/1991 Szegda
5,083,943 A 1/1992 Tarrant
5,127,853 A 7/1992 McMills et al.
5,131,862 A 7/1992 Gershfeld
5,141,451 A 8/1992 Down
5,181,161 A 1/1993 Hirose et al.
5,195,906 A 3/1993 Szegda
5,205,761 A 4/1993 Nilsson
5,207,602 A 5/1993 McMills et al.
5,217,391 A 6/1993 Fisher, Jr.
5,217,393 A 6/1993 Del Negro et al.
5,269,701 A 12/1993 Leibfried, Jr.
5,283,853 A 2/1994 Szegda
5,295,864 A 3/1994 Birch et al.
5,316,494 A 5/1994 Flanagan et al.
5,322,454 A 6/1994 Thommen
5,338,225 A 8/1994 Jacobsen et al.
5,340,332 A 8/1994 Nakajima et al.
5,342,218 A 8/1994 McMills et al.
5,352,134 A 10/1994 Jacobsen et al.
5,354,217 A 10/1994 Gabel et al.
5,371,819 A 12/1994 Szegda
5,371,821 A 12/1994 Szegda
5,371,827 A 12/1994 Szegda
5,393,244 A 2/1995 Szegda
5,431,583 A 7/1995 Szegda
5,435,745 A 7/1995 Booth
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,494,454 A 2/1996 Johnsen
5,501,616 A 3/1996 Holliday
5,525,076 A 6/1996 Down
5,542,861 A 8/1996 Anhalt et al.
5,548,088 A 8/1996 Gray et al.
5,571,028 A 11/1996 Szegda
5,586,910 A 12/1996 Del Negro et al.
5,598,132 A 1/1997 Stabile
5,607,325 A 3/1997 Toma
5,651,698 A 7/1997 Locati et al.
5,651,699 A 7/1997 Holliday
5,662,489 A * 9/1997 Stirling ..... 439/322
5,667,405 A 9/1997 Holliday
5,785,554 A 7/1998 Ohshiro
5,795,188 A 8/1998 Harwath
5,863,220 A 1/1999 Holliday
5,975,951 A 11/1999 Burris et al.
5,984,723 A 11/1999 Wild
5,993,254 A 11/1999 Pitschi et al.
5,997,350 A 12/1999 Burris et al.
6,019,636 A 2/2000 Langham
6,032,358 A 3/2000 Wild
6,034,325 A 3/2000 Nattel et al.
RE36,700 E 5/2000 McCarthy
6,080,015 A 6/2000 Andreescu
6,089,912 A * 7/2000 Tallis et al. ..... 439/584
6,168,455 B1 1/2001 Hussaini
6,733,336 B1 * 5/2004 Montena et al. ..... 439/578

* cited by examiner

CLAMPING AND SEALING MECHANISM WITH MULTIPLE RINGS FOR CABLE CONNECTOR

FIELD OF THE INVENTION

This invention relates generally to the field of cable connectors, and more particularly to a cable connector having multiple rings which provide the required clamping and sealing function via an interference fit between a ground sheath of a coaxial cable and a grounded portion of the connector body.

BACKGROUND OF THE INVENTION

Coaxial cable connectors, whether connecting coaxial cable to an equipment port or two cables to each other, rely on RF (radio frequency) shielding to prevent stray RF emanations from entering the cable system. It is important to ensure that the ground path is well established through the connector to thwart unwanted signals from penetrating the system. At the same time, it is important to prevent external environmental effects, such as moisture or grit, from entering the connector and degrading the shielding performance of the connector. There exist any number of types and styles of connectors with any number of internal parts to ensure that the shielding from stray emanations exists and to prevent outside moisture or contaminants from entering the connector. The multiplicity of these specialized parts adds to the complexity and cost of coaxial cable connectors.

SUMMARY OF THE INVENTION

Briefly stated, a two-piece cable connector includes a connector body and a threaded nut or compression fitting that attaches at a first end of the connector body. Two series of rings are interleaved with tapered sides adjacent each other, with the rings being fitted inside the connector body outside a portion of a mandrel. Two plastic rings are fitted adjacent the gapped metal rings at the first end of the connector body. The threaded nut or compression fitting drives the plastic rings against each other and the inboard ring against the series of rings in wedging engagement, thus creating an interference fit among the grounded connector body, the series of rings, a ground sheath of a coaxial cable, and the mandrel. The two plastic rings form a seal protecting the inside of the cable connector from the environment.

According to an embodiment of the invention, a cable connector includes a connector body having a cavity therein; a mandrel fitted inside the cavity for receiving a prepared coaxial cable end at an end of the connector body; a first plurality of rings fitted between a portion of the mandrel and the connector body and a second plurality of rings fitted between the first portion of the mandrel and the connector body, the first plurality of rings and the second plurality of rings having wedge-shaped cross-sections; the first plurality of rings and the second plurality of rings being interleaved with one another so that adjacent surfaces of first plurality of rings and the second plurality of rings are in tapered relationship with each other; at least the first plurality of rings being of electrically conductive material; a first sealing ring having a wedge-shaped cross section adjacent to one of the second plurality of rings and in tapered relationship with the one of the second plurality of rings, the first sealing ring being closer to the end of the connector body than the first and second pluralities of rings; a second sealing ring adjacent the first sealing ring, the second sealing ring being closer to the end of the connector body than the first sealing ring, and the second sealing ring having a surface in tapered relationship with a tapered surface of the first sealing ring; and driving means, attached to the connector body at the end of the connector body, for driving the second sealing ring into wedging engagement with the first sealing ring, thereby driving the first sealing ring to drive the first and second pluralities of rings into wedging engagement with each other.

According to an embodiment of the invention, a method for constructing a cable connector includes the steps of (a) providing a connector body having a cavity therein; (b) providing a mandrel fitted inside the cavity for receiving a prepared coaxial cable end at an end of the connector body; (c) providing a first plurality of rings fitted between a portion of the mandrel and the connector body and a second plurality of rings fitted between the first portion of the mandrel and the connector body, wherein the first plurality of rings and the second plurality of rings have wedge-shaped cross-sections, and wherein at least the first plurality of rings are of electrically conductive material; (d) interleaving the first plurality of rings and the second plurality of rings with one another so that adjacent surfaces of first plurality of rings and the second plurality of rings are in tapered relationship with each other; (e) providing a first sealing ring having a wedge-shaped cross section adjacent to one of the second plurality of rings and in tapered relationship with the one of the second plurality of rings, the first sealing ring being closer to the end of the connector body than the first and second pluralities of rings; (f) providing a second sealing ring adjacent the first sealing ring, the second sealing ring being closer to the end of the connector body than the first sealing ring, and the second sealing ring having a surface in tapered relationship with a surface of the first sealing ring; and (g) driving the second sealing ring into wedging engagement with the first sealing ring, thereby driving the first sealing ring to drive the first and second pluralities of rings into wedging engagement with each other.

DETAILED DESCRIPTION OF THE PREFERRED EMBODIMENT

Figure 1:
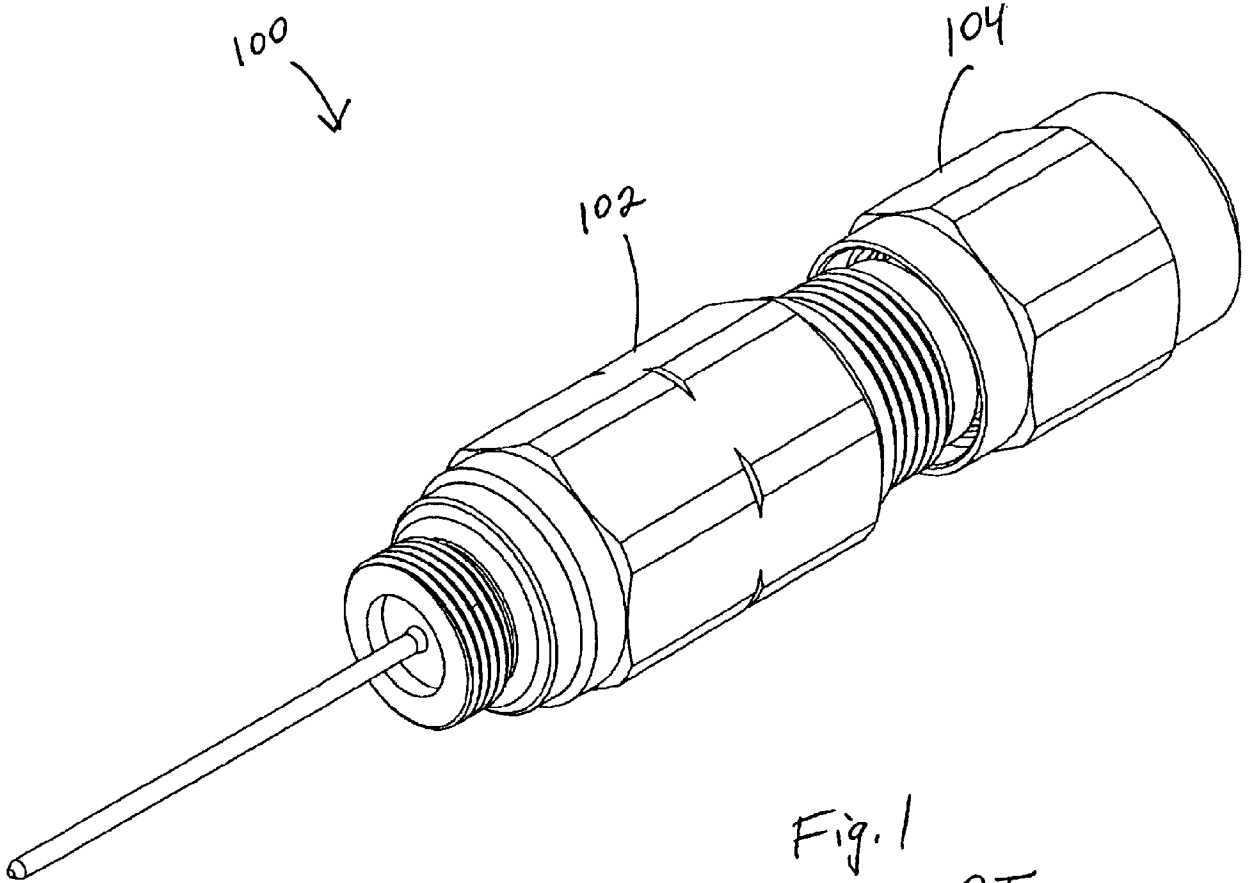
Fig. 1 PRIOR ART
FIG. 1 shows a perspective view of a typical two-piece pin connector according to the prior art.
Figure 2:
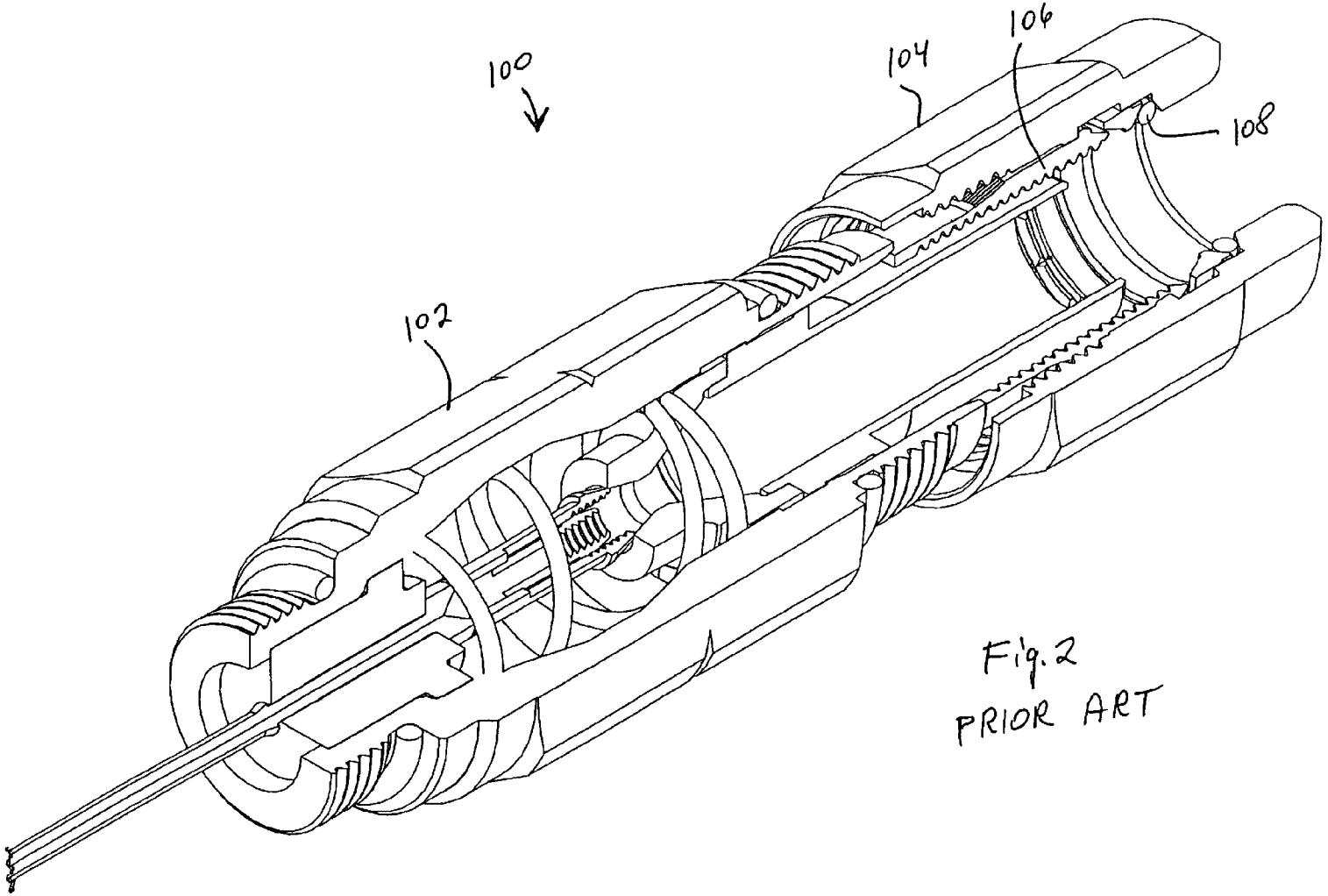
Fig. 2 PRIOR ART
FIG. 2 shows a cutaway perspective view of the prior art connector of FIG. 1.
Figure 3:
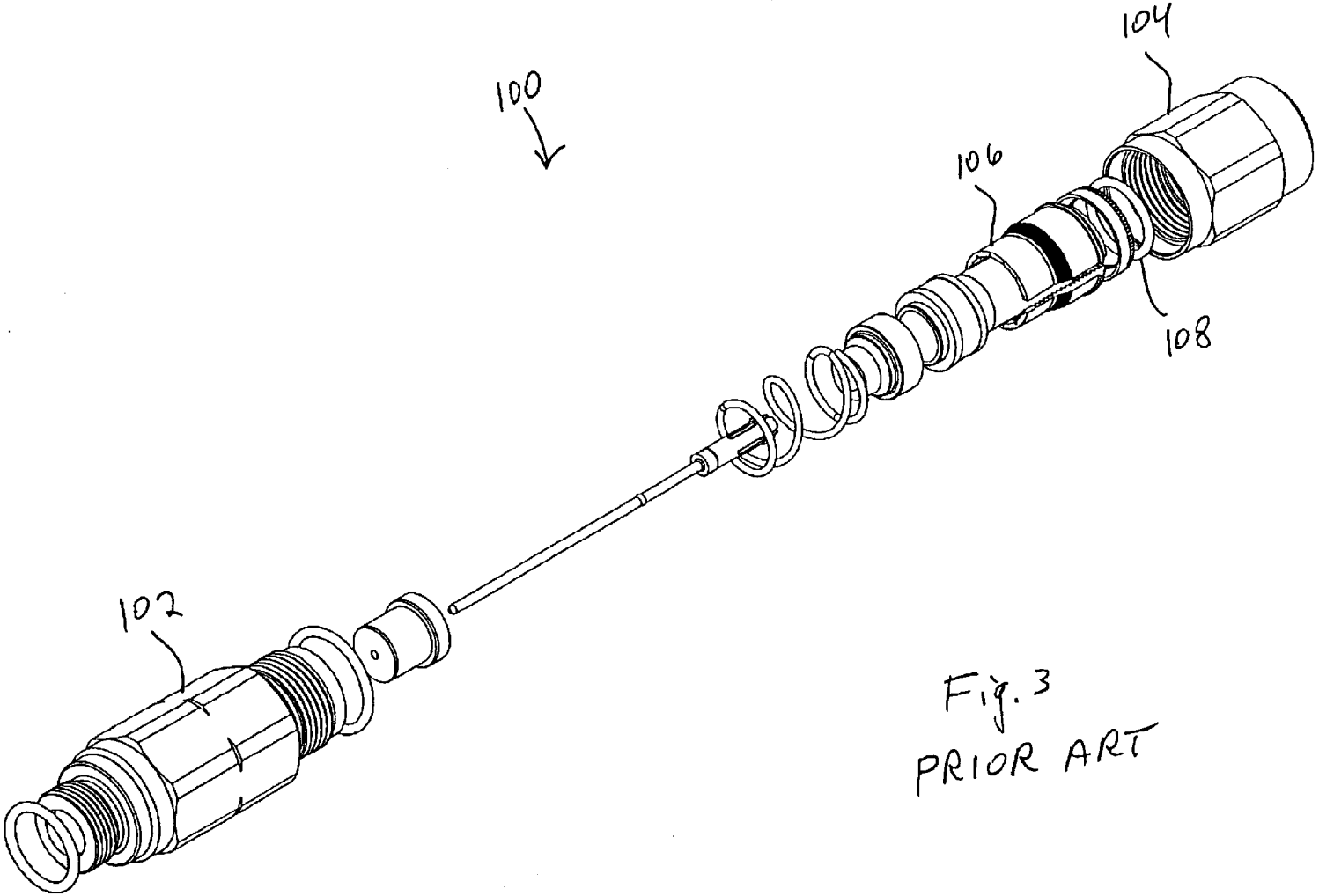
Fig. 3 PRIOR ART
FIG. 3 shows an exploded perspective view of the prior art connector of FIG. 1.

Referring to FIGS. 1–3, a prior art two-piece cable connector 100 includes a nut 104 fastened onto a connector body 102. A clamp 106 is pressed against a prepared cable ground sheath (not shown) of a coaxial cable (not shown) as nut 104 is tightened onto connector body 102. An O-ring 108 seals against an outer coating (not shown) of the coaxial cable to prevent moisture or contaminants from affecting the cable connection with cable connector 100. It is evident in FIG. 3 that the component pieces cable connector 100, although not numerous, have to be specially made in the right configurations of the proper materials in order to have cable connector 100 work properly.

Figure 4:
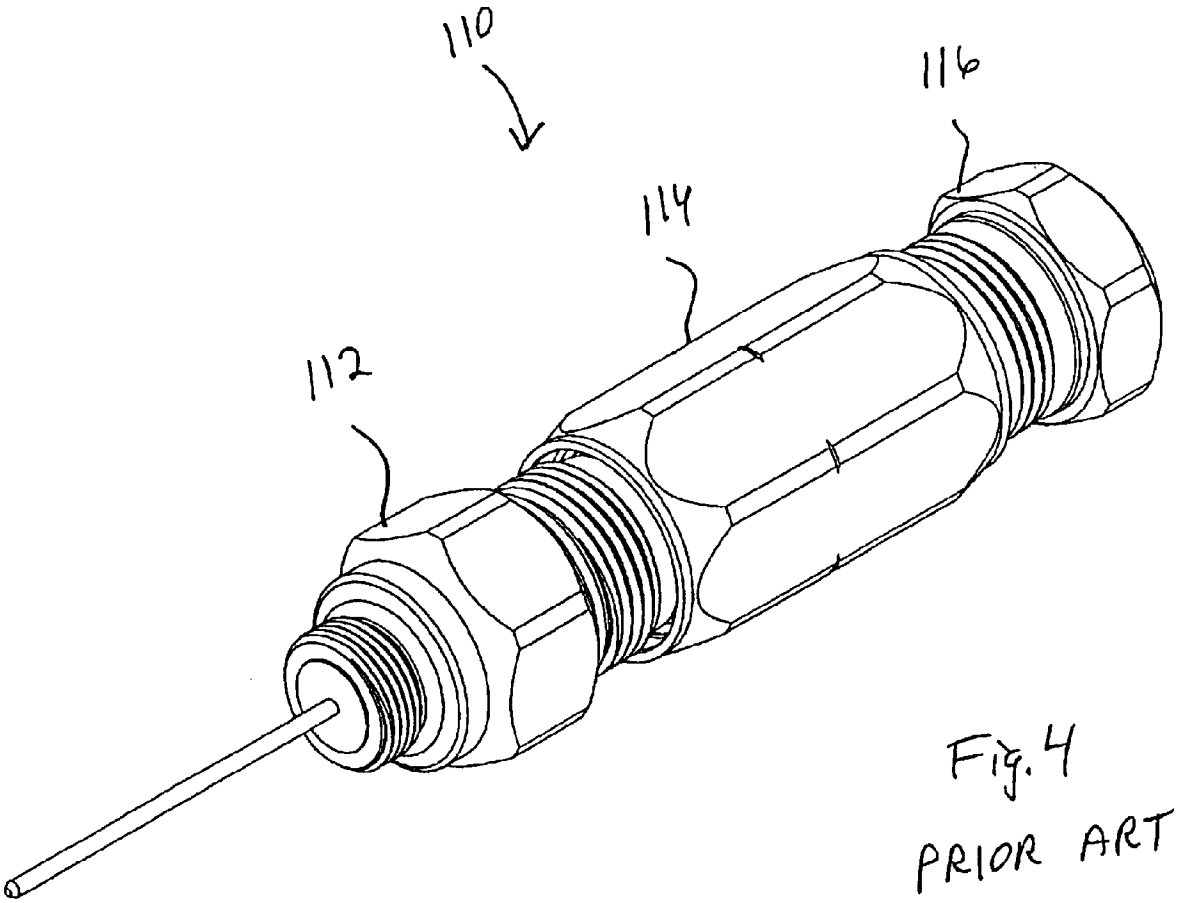
Fig. 4 PRIOR ART
FIG. 4 shows a perspective view of a typical three-piece connector according to the prior art.
Figure 5:
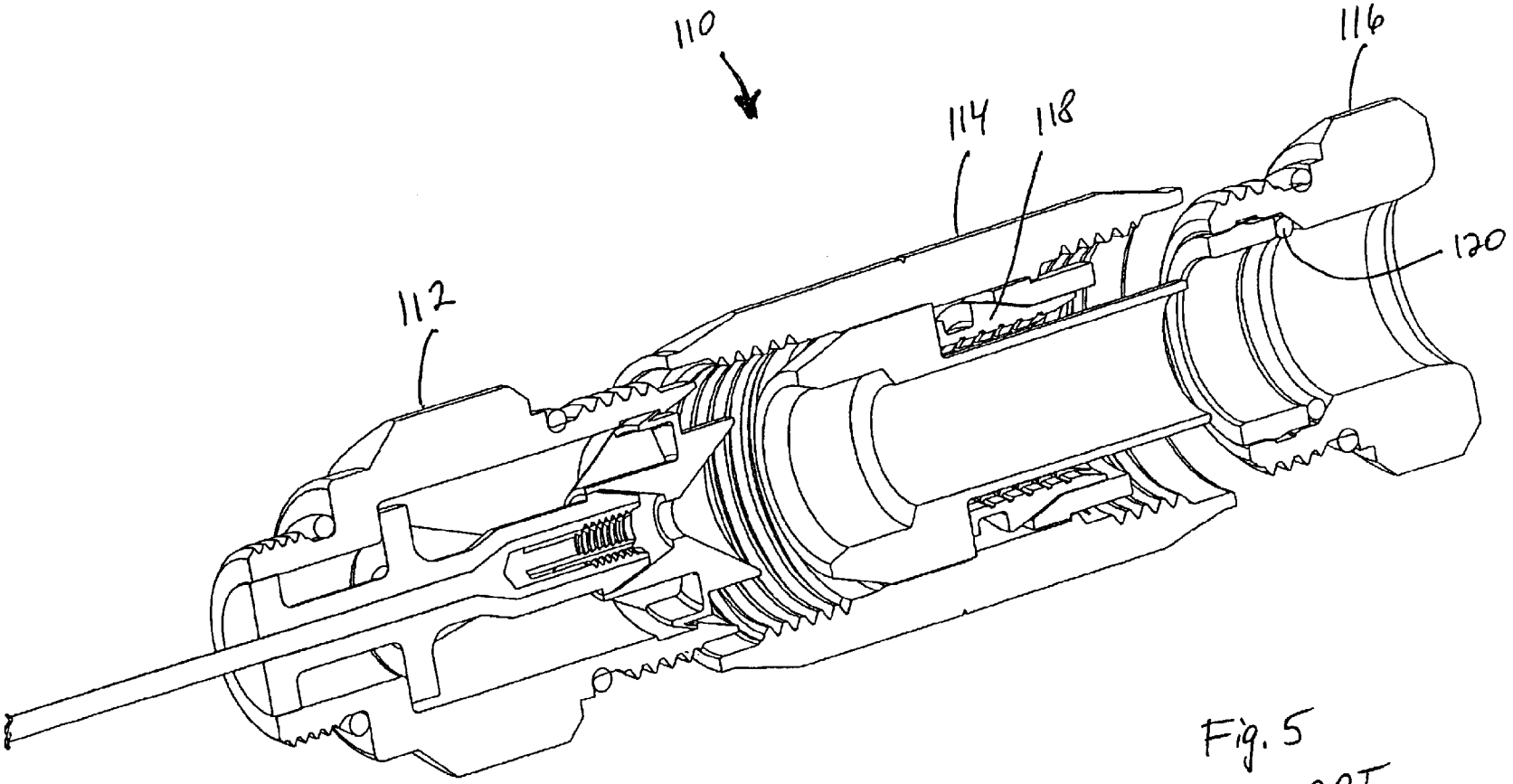
Fig. 5 PRIOR ART
FIG. 5 shows a cutaway perspective view of the prior art connector of FIG. 4.
Figure 6:
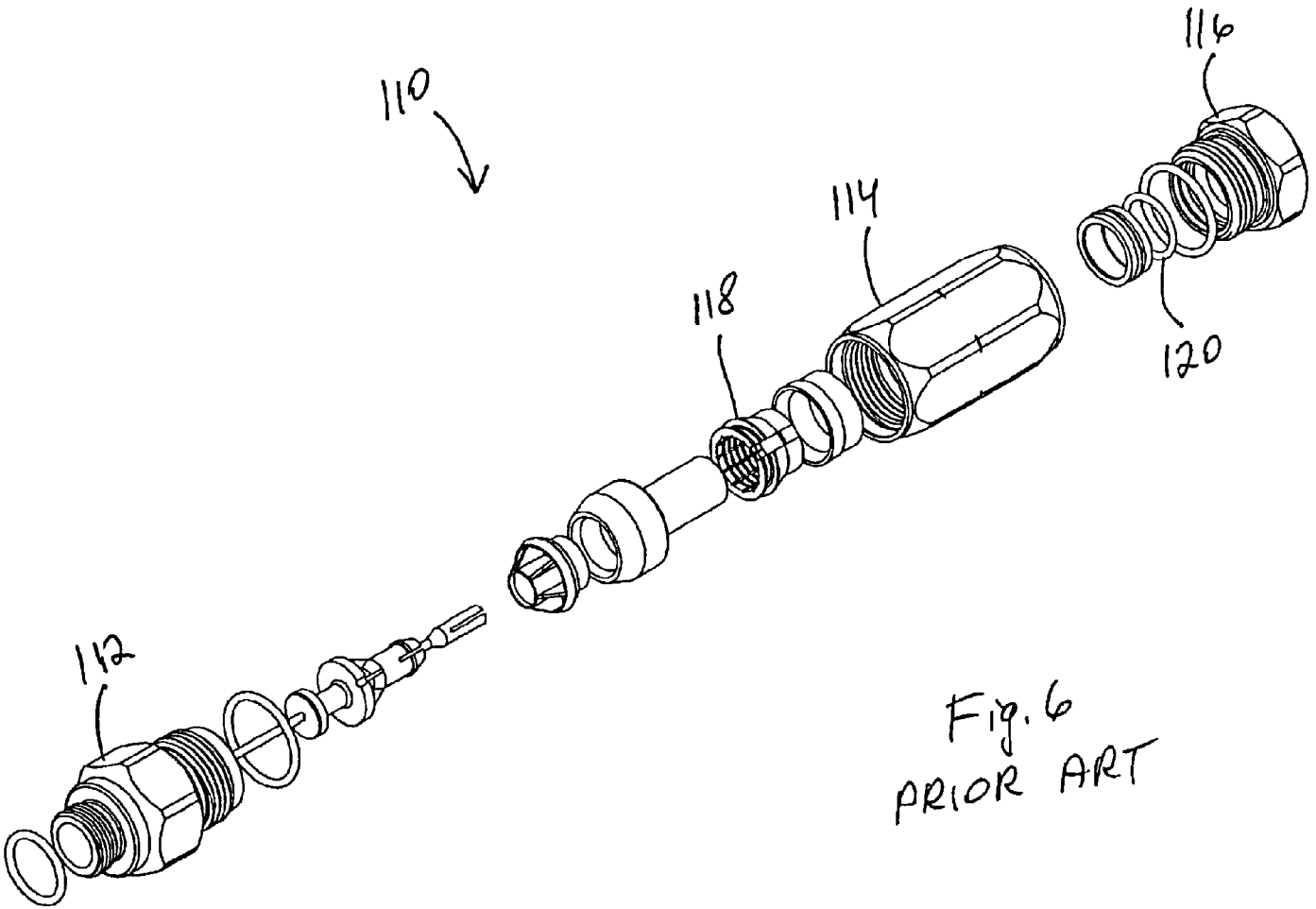
Fig. 6 PRIOR ART
FIG. 6 shows an exploded perspective view of the prior art connector of FIG. 4.

Referring to FIGS. 4–6, a prior art three-piece connector 110 includes a front body 112, a back body 114 screwed onto front body 112, and a nut 116 screwed onto back body 114. A clamp 118 presses against the prepared cable ground sheath when nut 116 is tightened onto back body 114, while an O-ring 120 performs the necessary sealing function. It is clear from FIG. 6 that the individual pieces that are required to be made of a conducting material, such as metal, have to be precisely machined.

Figure 7:
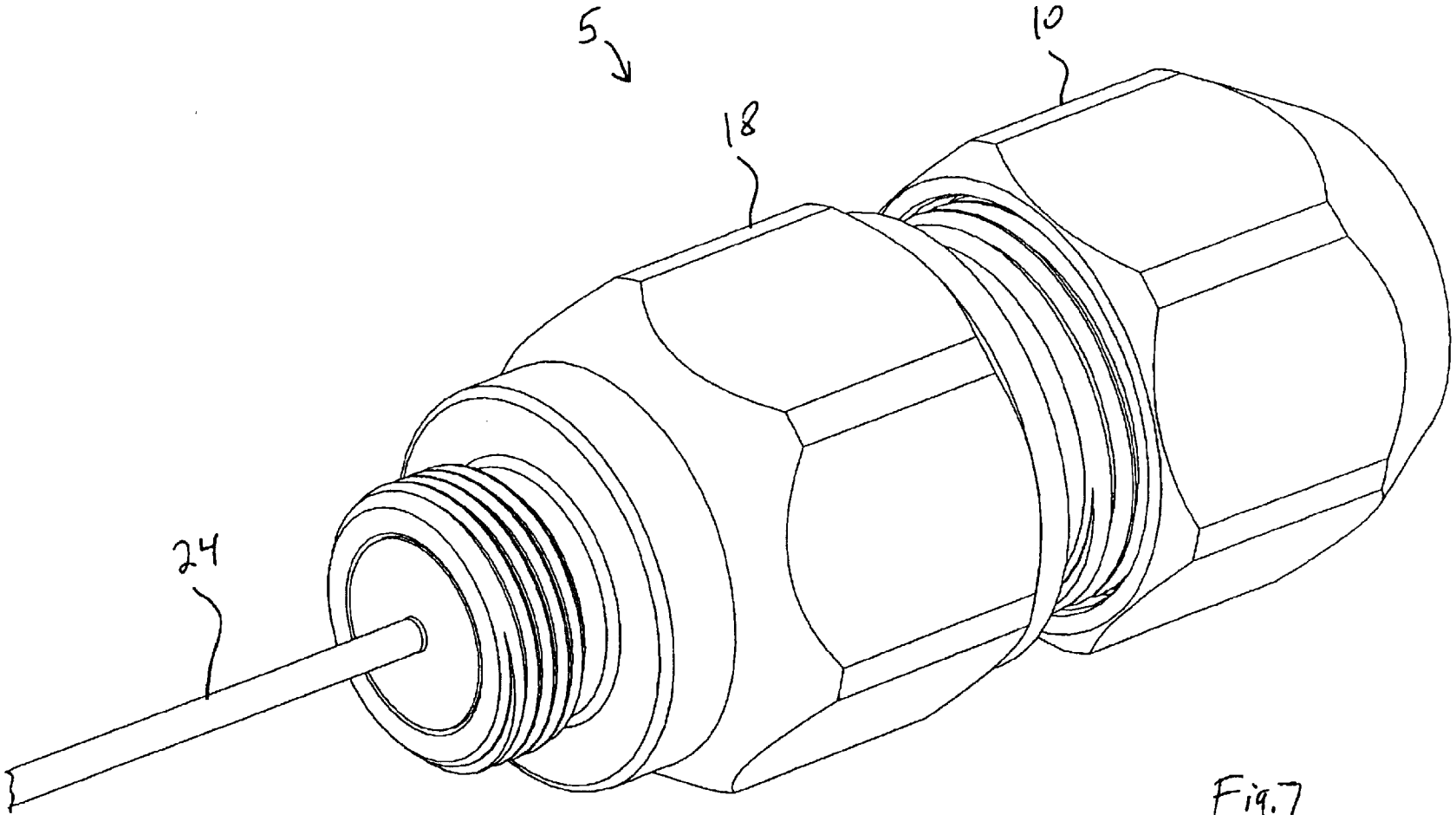
FIG. 7 shows a perspective view of a two-piece connector according to an embodiment of the invention.
Figure 8:
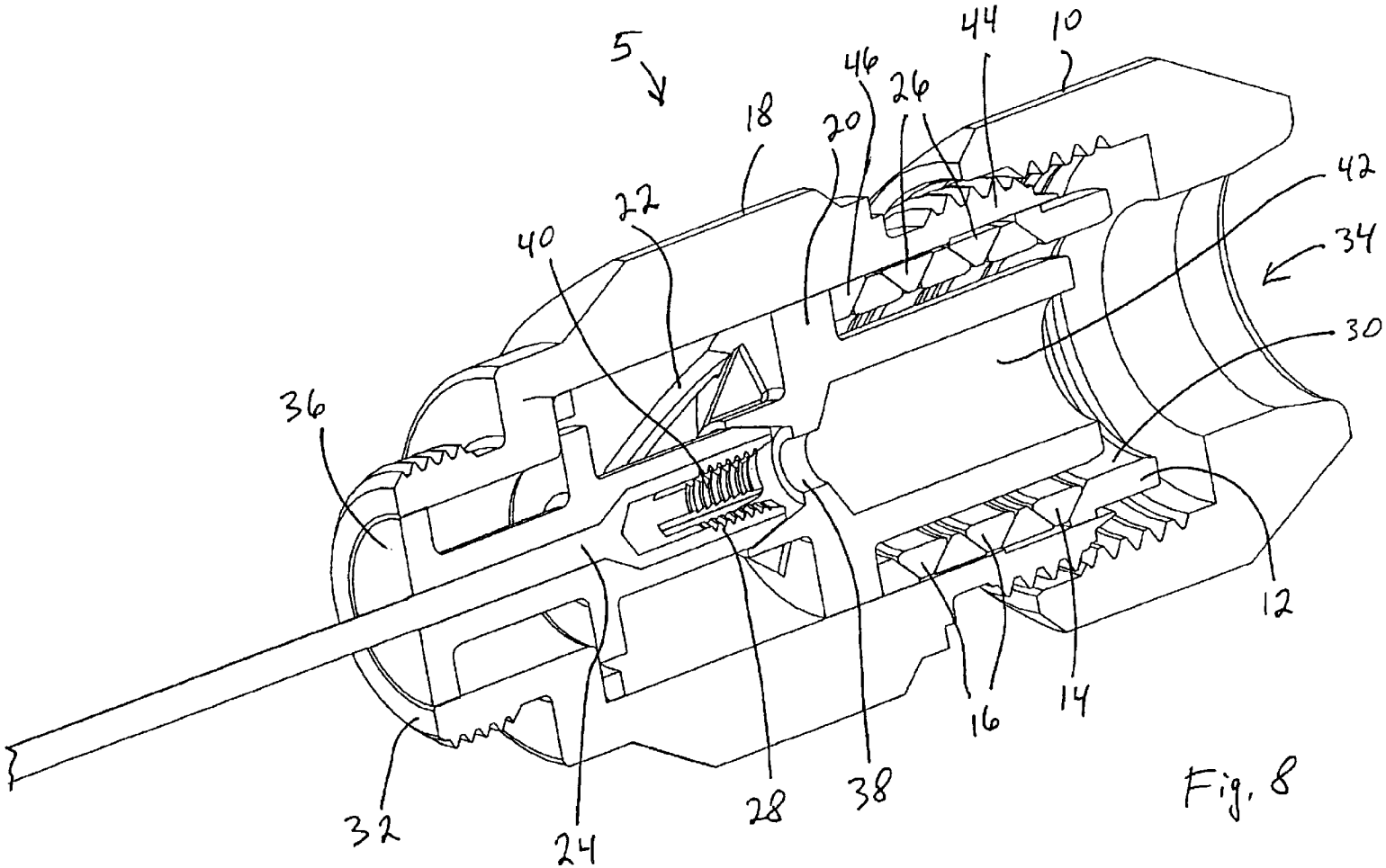
FIG. 8 shows a cutaway perspective view of the embodiment of FIG. 7.
Figure 9:
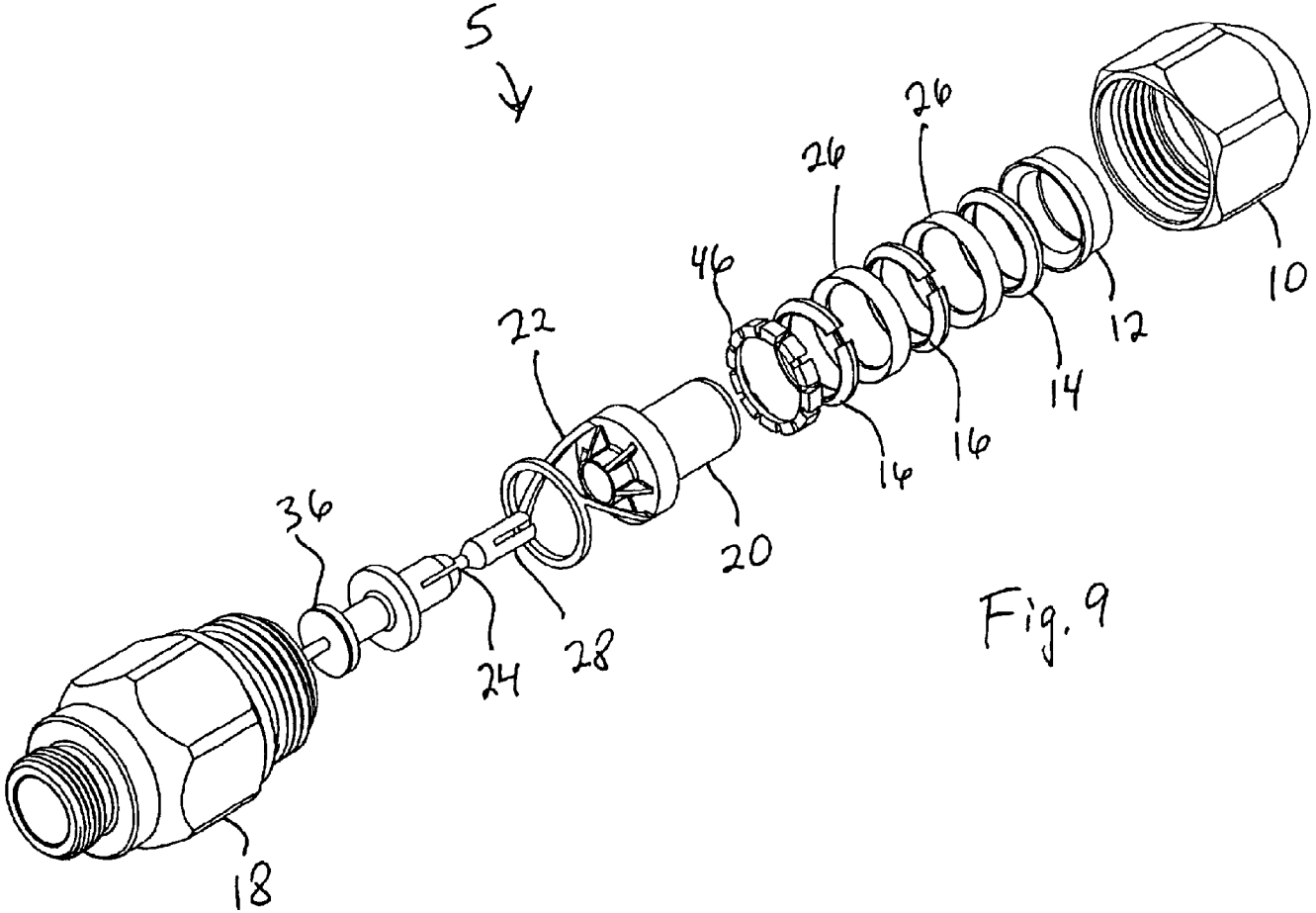
FIG. 9 shows an exploded perspective view of the embodiment of FIG. 7.

Referring to FIGS. 7–9, a cable connector 5 according to an embodiment of the invention is shown. A connector body 18 provides a housing for an end of the cable (not shown) which is connected to an equipment port (not shown) via a grounded end 32 and a conductive pin 24. Conductive pin 24 is electrically connected to a center conductor (not shown) of the cable while end 32 of body 18 is electrically connected to the ground sheath (not shown) of the cable, as is explained below. The invention is not dependent on the particular type of cable connector shown here, but is applicable to any connection between a cable and a cable connector.

Conductive pin 24 is held in place in body 18 by an insulator 36, which also prevents conductive pin 24 from making electrical contact with body 18. Body 18 has to be electrically conductive because it constitutes part of the ground path from the cable ground sheath to end 32 which is connectable to the grounding circuit of the equipment port. The cable end is prepared for connection to connector 5 by stripping part of a dielectric layer (not shown) away from the center conductor of the cable, and by stripping away part of an insulating layer (not shown) covering the ground sheath when the cable includes an insulating layer.

The prepared cable end is inserted into connector 5 through a nut 10 and then an end 34 of body 18 so that the center conductor is guided by a portion 38 of a mandrel 20 into a collet 28. Collet 28 preferably includes threads 40 to provide an interference fit with the cable center conductor. The dielectric layer of the cable fits inside a main cavity 42 of mandrel 20, while the ground sheath of the cable fits between a surface portion 30 of mandrel 20 and a plurality of rings made up of inner rings 16 and outer rings 26. Inner rings 16 preferably provide electrical continuity and grip the cable ground sheath when nut 10 is tightened, while the tapered surfaces of outer rings 26 guide inner rings 16 into position when nut 10 is tightened. A deformable segmented ring 46 is preferably between a shoulder of mandrel 20 and the forwardmost inner ring 16. Surface portion 30 of mandrel 20 is preferably scored to enhance the interference fit between mandrel 20 and the ground sheath of the cable.

An inner ring 14 and an outer ring 12 are preferably of plastic. Inner ring 14 grips the cable ground sheath when nut 10 is tightened, while inner ring 14 and outer ring 12 provide the sealing function provided by O-ring 108 (FIGS. 1–3) and O-ring 120 (FIGS. 4–6) in the prior art. Note that inner ring 14 and inner rings 16 are adjacent at least one outer ring 26. Cross-sections of rings 14, 16, 26, and 46 are all wedge shaped, i.e., shaped substantially as trapezoids, with adjacent rings touching each other via tapered sides. Outer ring 12 is preferably adjacent inner ring 14. A flat portion of outer rings 26 and outer ring 12 is adjacent and touching body 18, while a flat portion of inner ring 14 and inner rings 16 is adjacent and touching the ground sheath of the cable.

Rings 46, 16, and 26 are preferably of a conducting material with metal being the preferred material, but not all of rings 16 and 26 have to be electrically conductive as long as ring 46 and the forwardmost ring 16 are electrically conductive to provide the electrical ground path from the cable ground sheath to connector body 18.

Inner rings 16 are preferably gapped rings, i.e., a portion is missing in the angular direction of the ring, so that the gap permits the inner diameter of the rings to contract when a force is applied to the outside diameter of the rings. Rings 12 and 14 are preferably complete rings and made of plastic, but when conventional O-ring sealing is used instead as in the prior art, rings 12 and 14 can be of metal instead of plastic, i.e., metal rings 12 and 14 in conjunction with an O-ring will also perform the sealing function required.

When nut 10 is screwed onto body 18, a portion 44 of body 18 is compressed inwards by nut 10, which in turn presses against the outer diameter of rings 14, 16, and 26. In addition, nut 10 drives ring 12 into a wedging engagement with rings 14, 16, and 26. Outer ring 12, which can be of metal but is preferably of plastic in this embodiment, first engages ring 14, also preferably of plastic in this embodiment, so that ring 14 compresses forward and radially to establish a moisture seal and mechanical seal on the ground sheath of the cable, thereby replacing the sealing O-rings common in the prior art.

Ring 14 in turn applies pressure on the series of rings 16 and 26, which provide an interference fit with each other, portion 44 of body 18, and the ground cable sheath, as well as an interference fit between the ground cable sheath and surface 30 of mandrel 20. Because metal rings 16 and 26 provide good electrical contact in several narrow, high pressure bands, as well as providing a good mechanical grip, they thus replace both the sheath clamp and the RF clamp common in the prior art. When ring 12 is of plastic, ring 12 also acts as a thrust bearing between rotating nut 10 and rings 16, 26 which should not rotate in order to avoid twisting of the cable during installation. Although though this embodiment is described using a nut to provide the compressive force to ring 12, a compression fitting could be used instead, such as is disclosed in U.S. patent application Ser. No. 10/686,204 filed on Oct. 15, 2003 and entitled APPARATUS FOR MAKING PERMANENT HARDLINE CONNECTION, incorporated herein by reference. The disadvantage to a compression fitting is that once the connector is connected to the cable, it is not easily disconnected without damaging the cable end.

In this embodiment, with inner rings 16 and outer rings 26 being of a conducting material such as metal to provide part of the ground circuit path between the ground sheath of the cable and body 18, mandrel 20 can be of a non-conducting material such as plastic because mandrel 20 is not needed to establish any part of the ground circuit between the cable ground sheath and body 18. A plastic mandrel 20 can thus be designed to simply reinforce mechanically the ground sheath to keep it from collapsing due to the compression action of rings 16, 26. High performance thermoplastics provide the necessary strength to serve the mechanical reinforcement function.

Using a plastic mandrel 20 also eliminates possible electrical shorting between the center conductor and the ground circuit. Using a plastic mandrel 20 also permits the use of a plurality of spring leafs 22 preferably made one-piece with mandrel 20 to help exert opening forces to disengage mandrel 20 from collet 28 when disassembling connector 5. The use of plastic spring leafs 22 does away with using a metal coil for the purpose as is known in the prior art, which eliminates the complicating effects of the metal coil on the RF signal transmission capability of the connector. Portion 38 of mandrel 20 is part of the seizure bushing known in the prior art, which in this embodiment can be made one-piece with mandrel 20. This embodiment of connector 5 also eliminates the risk of arcing when installing the connector on a "live" cable, because at no point along the connector is it possible to touch the center conductor of the cable to a conductive grounded surface inside the connector.

Figure 10:
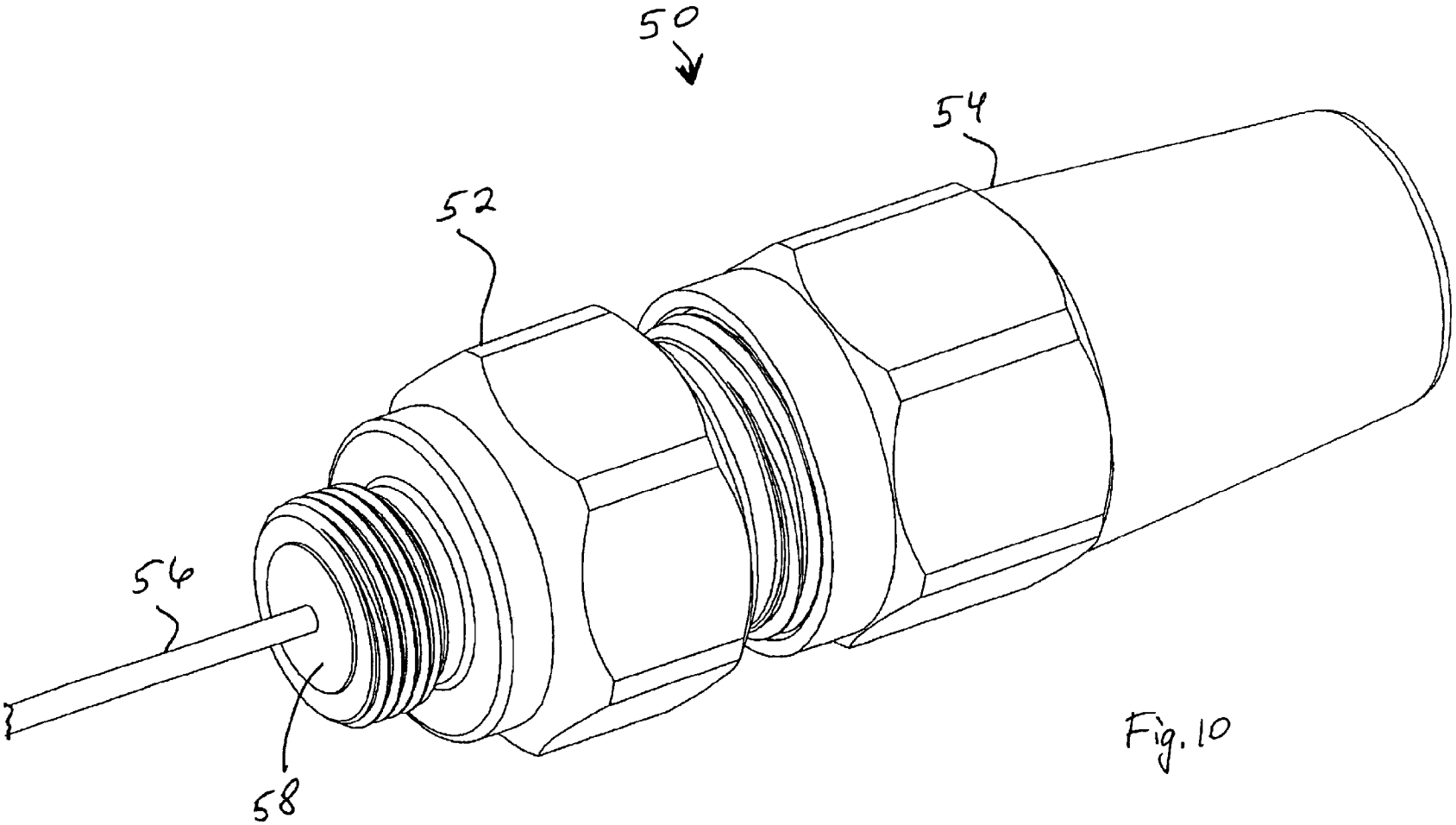
FIG. 10 shows a perspective view of a two-piece connector according to an embodiment of the invention.
Figure 11:
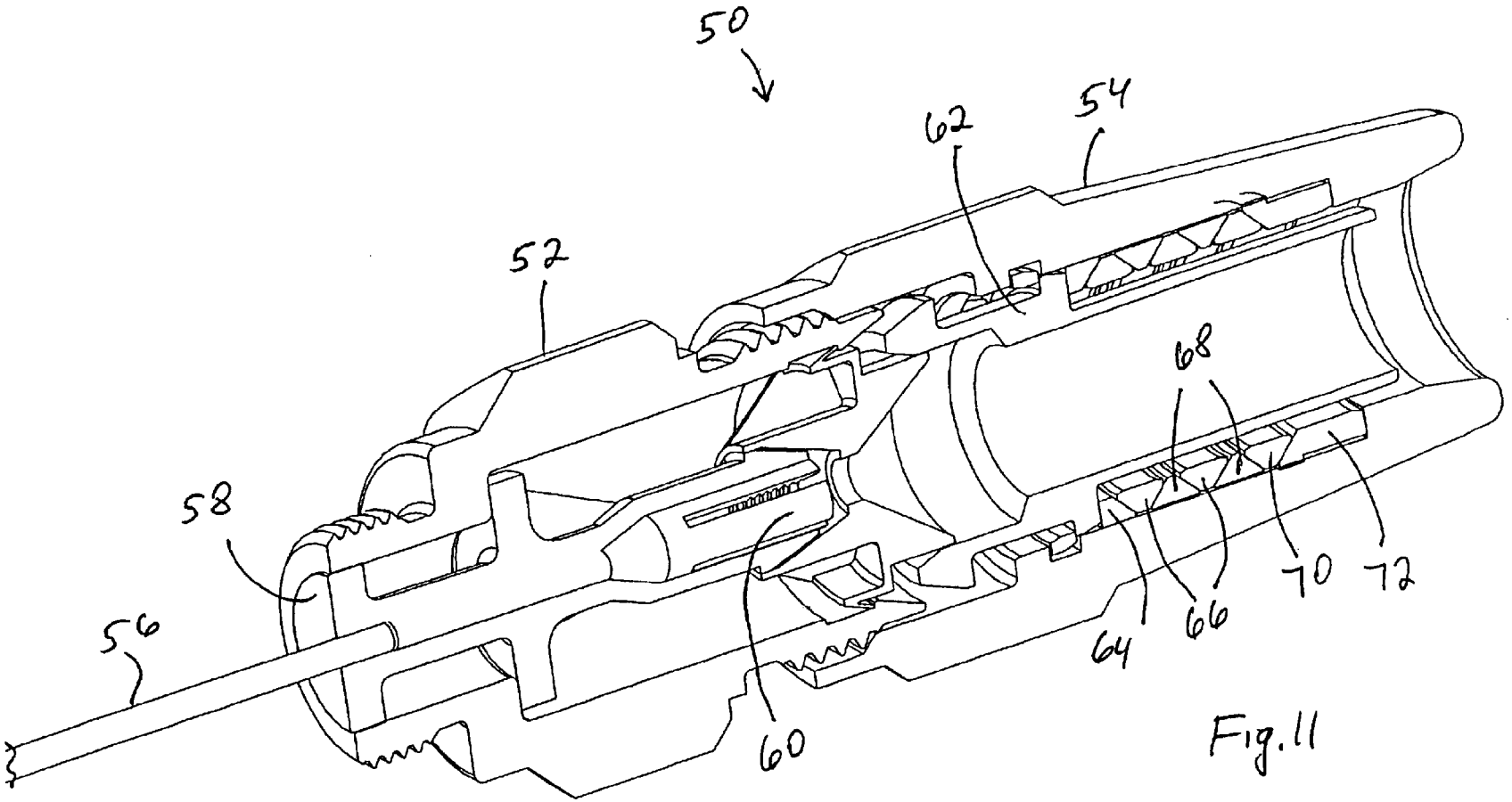
FIG. 11 shows a cutaway perspective view of the embodiment of FIG. 10.
Figure 12:
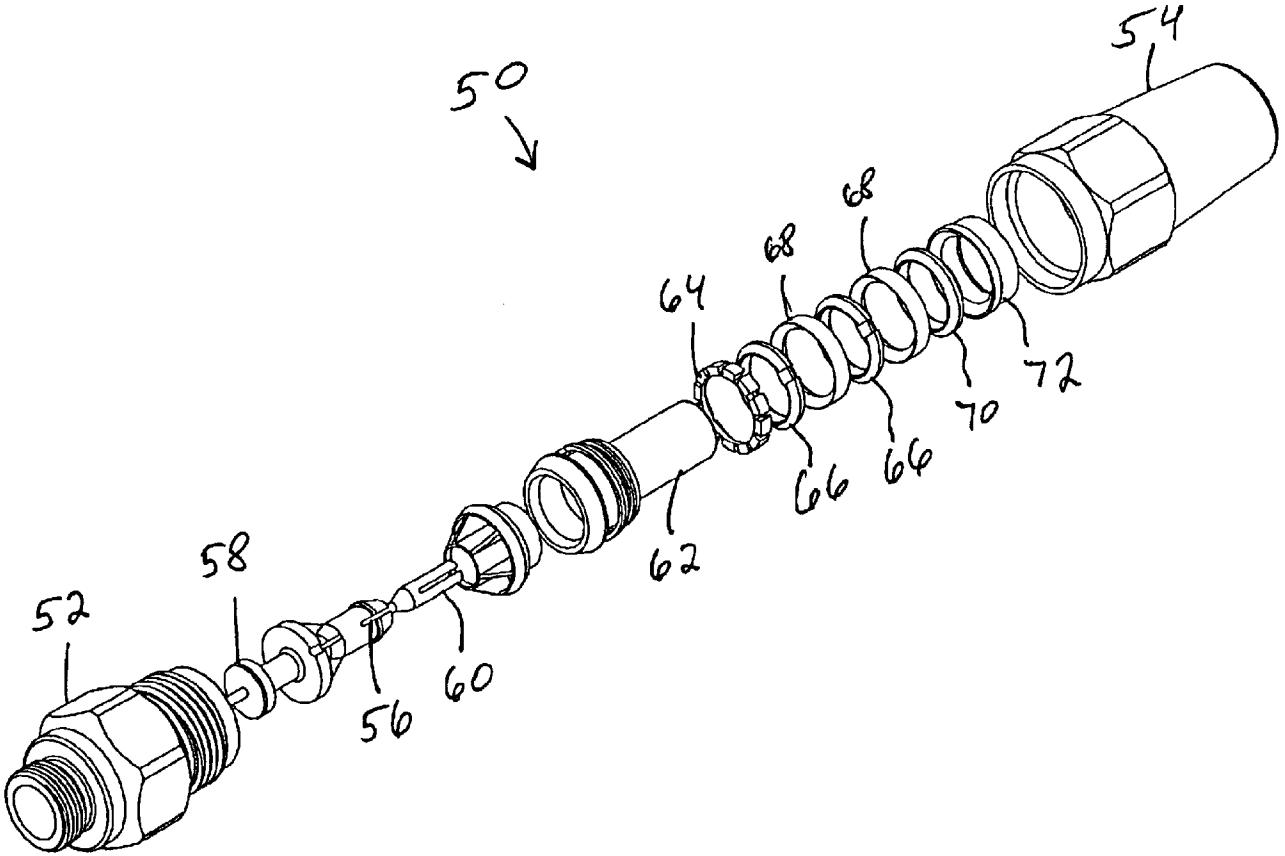
FIG. 12 shows an exploded perspective view of the embodiment of FIG. 10.

Referring to FIGS. 10–12, an alternate two-piece embodiment of the invention is shown. A cable connector 50 includes a connector body 52 with a nut 54 which screws onto connector body 52. A conductive pin which is to make electrical contact with the center conductor of the prepared cable is held in place by an insulator 58. A collet 60 seizes the center conductor of the cable when the cable end is attached to cable connector 50. A mandrel 62 helps to guide the prepared cable end during installation as well as forcing the ground sheath of the cable to be separated from the dielectric layer of the cable. The ground sheath is captured between mandrel 62 and a plurality of inner rings 66. Outer rings 64 and 68 are similar to outer rings 46 and 26 of the embodiment of FIGS. 7–9, while inner rings 66 are similar to inner rings 16 of the embodiment of FIGS. 7–9. Inner ring 70 performs a similar function as inner ring 14, while outer ring 72 performs a similar function as outer ring 12. The difference between this embodiment and the embodiment of FIGS. 7–9 is the fashion in which nut 54 connects with mandrel 62, and this alternate embodiment is presented to show how the multiple clamping and sealing rings of the present invention can be adapted to different connector body coupler configurations.

Figure 13:
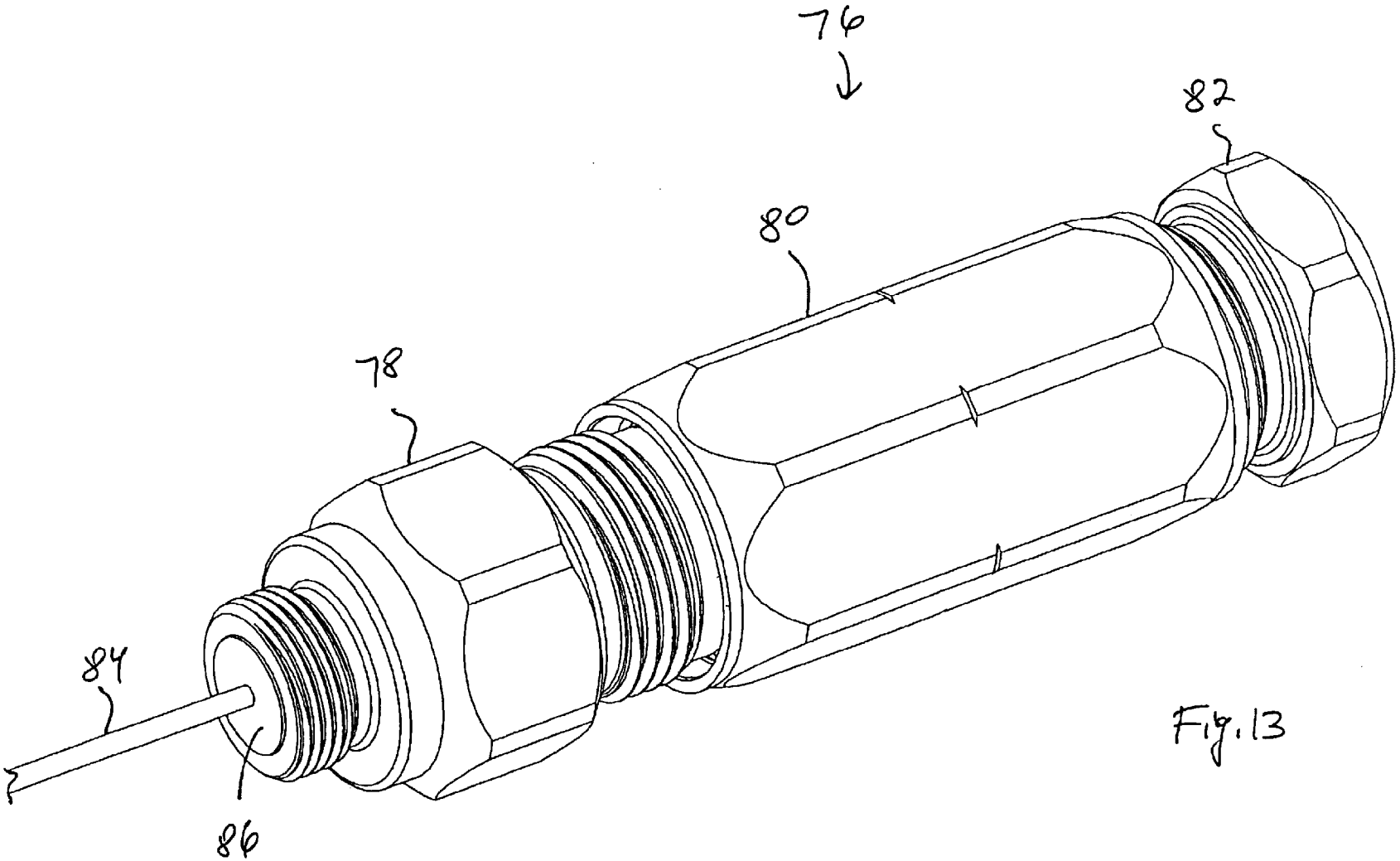
FIG. 13 shows a perspective view of a three-piece connector according to an embodiment of the invention.
Figure 14:
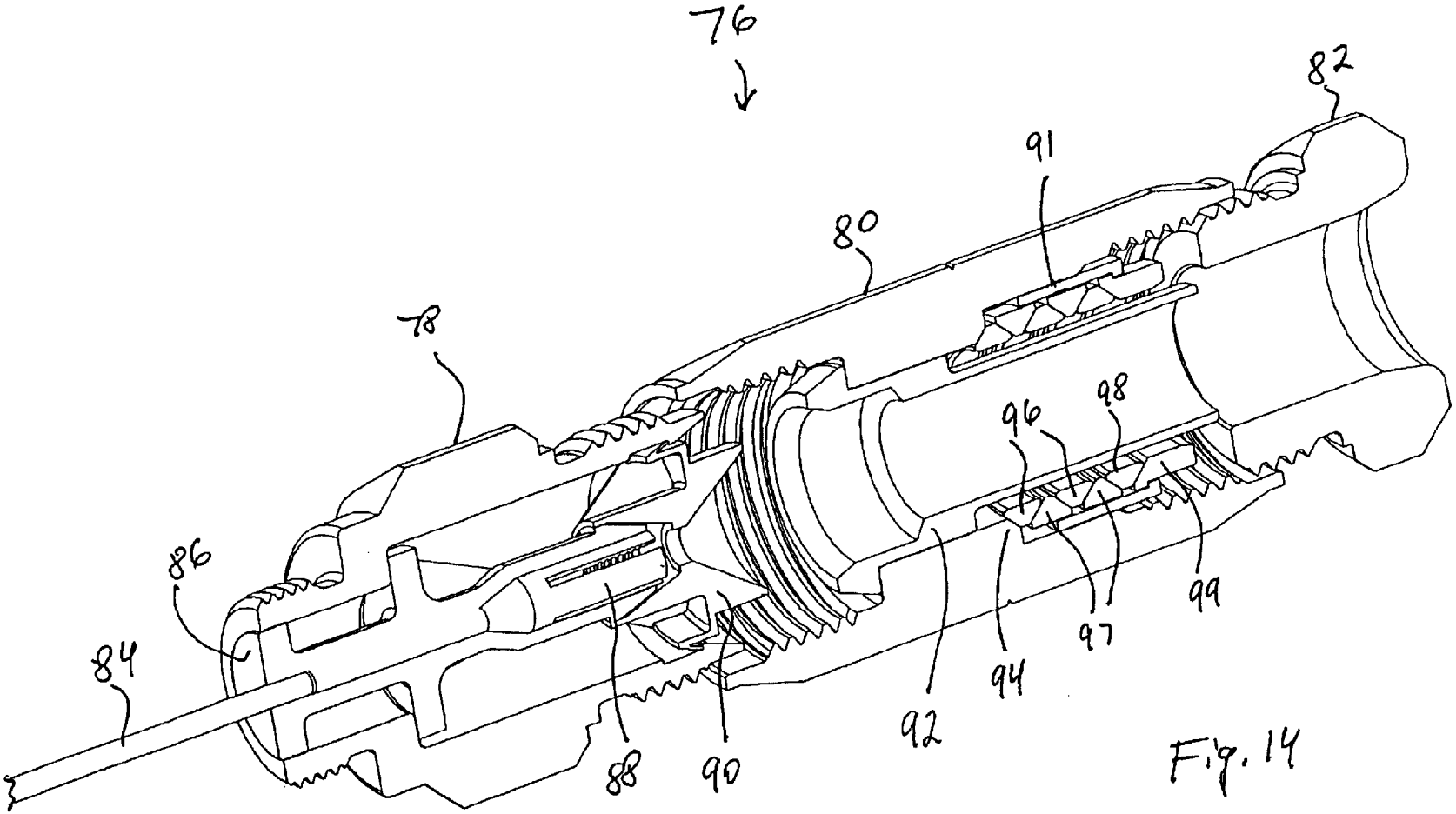
FIG. 14 shows a cutaway perspective view of the embodiment of FIG. 13.
Figure 15:
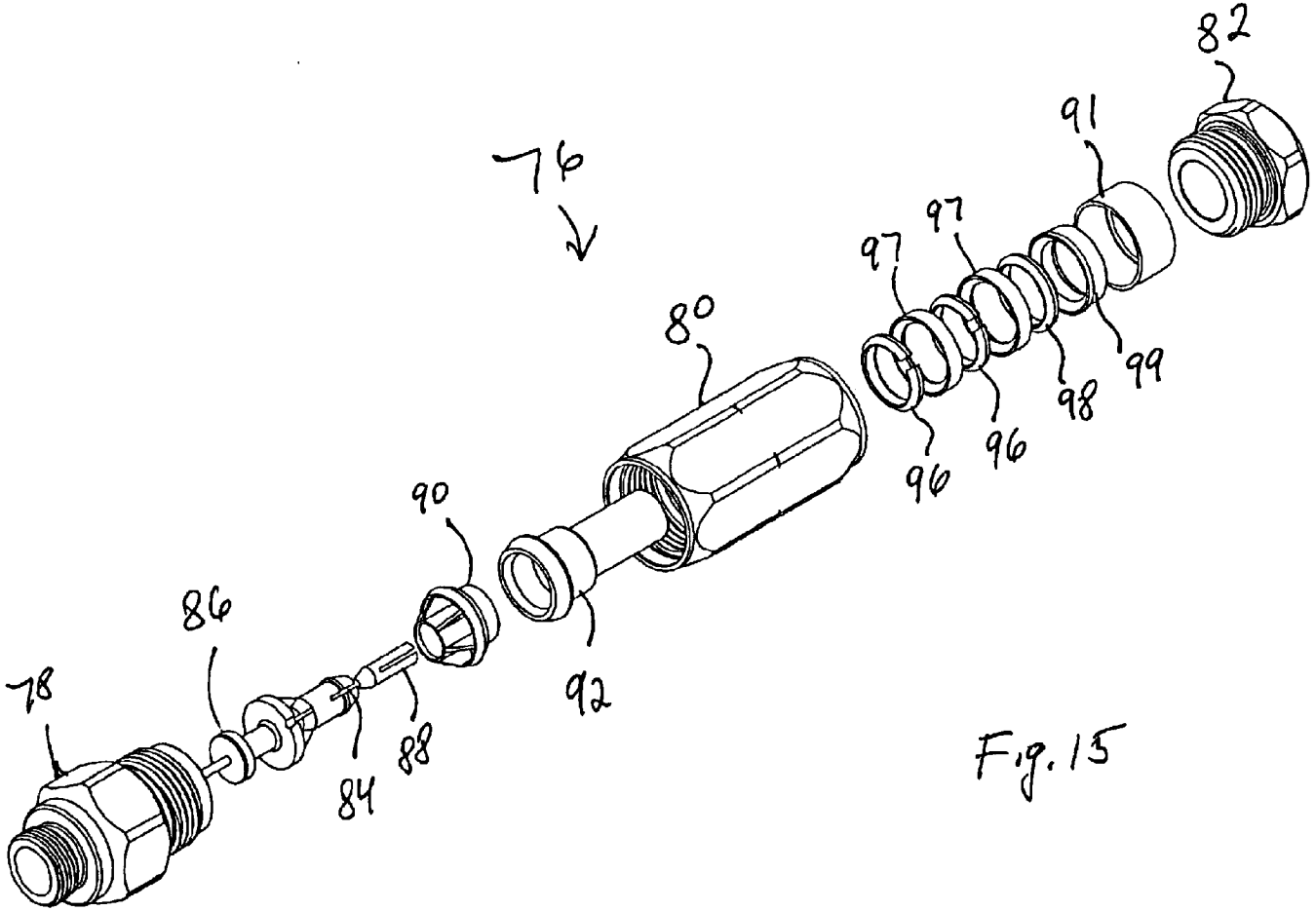
FIG. 15 shows an exploded perspective view of the embodiment of FIG. 13.

Referring to FIGS. 13–15, a three-piece pin connector is shown in which a cable connector 76 includes a front body 78, a back body 80, and a nut 82. The purpose of the three-piece pin connector is to allow fastening front body 78 to an equipment port before connecting the cable to back body 80 and screwing the combination of the cable and back body 80 to front body 78. Screwing nut 82 forces the clamping and sealing mechanism of the invention against both back body 80 and the prepared cable end. As in the above embodiments, a conductive pin 84 is held in place by an insulator 86. A collet 88 at one end of conductive pin 84 receives the center conductor of the cable as it is guided by a bushing/guide 90. A mandrel 92 receives the dielectric layer of the cable end on its inside, with the conductive ground sheath positioned between mandrel 92 and the clamping and sealing mechanism of the present invention, which includes inner rings 96, inner ring 98, outer rings 97, and outer ring 99. A thrust bearing 91 ensures that the cable is not twisted as back body 80 is screwed onto front body 78. Note that unlike the previous embodiments, the ring corresponding to ring 46 in the embodiment of FIGS. 7–9 and to ring 64 in the embodiment of FIGS. 10–12 is replaced functionally by a beveled shoulder 94 which is part of back body 80. When nut 82 is screwed onto back body 80, the multi-ring clamping and sealing mechanism functions as previously described in the other embodiments.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A cable connector, comprising:

a connector body having a cavity therein;

a mandrel fitted inside said cavity for receiving a prepared coaxial cable end at an end of said connector body;

a first plurality of rings fitted between a portion of said mandrel and said connector body and a second plurality of rings fitted between said portion of said mandrel and said connector body, said first plurality of rings and said second plurality of rings having wedge-shaped cross-sections;

said first plurality of rings and said second plurality of rings being interleaved with one another so that adjacent surfaces of first plurality of rings and said second plurality of rings are in tapered relationship with each other;

at least one of said first plurality of rings being of electrically conductive material;

a first sealing ring having a wedge-shaped cross section adjacent to one of said second plurality of rings and in tapered relationship with said one of said second plurality of rings, said first sealing ring being closer to said end of said connector body than said first and second pluralities of rings;

a second sealing ring adjacent said first sealing ring, said second sealing ring being closer to said end of said connector body than said first sealing ring, and said second sealing ring having a surface in tapered relationship with a tapered surface of said first sealing ring; and driving means, attached to said connector body at said end of said connector body, for driving said second sealing ring into wedging engagement with said first sealing ring, thereby driving said first sealing ring to drive said first and second pluralities of rings into wedging engagement with each other.

2. A cable connector according to claim 1, wherein said first plurality of rings are gapped.

3. A cable connector according to claim 1, further including a segmented ring disposed between a shoulder of said mandrel and said first plurality of rings.

4. A cable connector according to claim 3, wherein said segmented ring has a tapered surface only on a side adjacent said first plurality of rings.

5. A cable connector according to claim 1, wherein a shoulder of said connector body has a tapered surface adjacent one of said first plurality of rings.

6. A cable connector according to claim 1, wherein said sealing rings are plastic.

7. A cable connector according to claim 1, wherein when a ground sheath of said coaxial cable is interposed between said first portion of said mandrel and said first and second plurality of rings, said driving means causes an interference fit among said connector body, said first and second pluralities of rings, said ground sheath, and said portion of said mandrel.

8. A cable connector according to claim 7, wherein said interference fit among said connector body, said first and second pluralities of rings, and said ground sheath establishes a ground path connection between said ground sheath and said connector body.

9. A cable connector according to claim 8, wherein said mandrel is of plastic.

10. A cable connector according to claim 1, wherein said driving means is effective for causing said first and second sealing rings to seal an inside of said cable connector from an external environment.

11. A cable connector according to claim 1, wherein said driving means includes a nut having a plurality of internal threads that engage a plurality of external threads on said end of said connector body.

12. A cable connector according to claim 11, wherein said first sealing ring is a thrust bearing between said driving means and said first and second pluralities of rings.

13. A cable connector according to claim 1, wherein said mandrel is of plastic.

14. A cable connector according to claim 13, further comprising a plurality of spring leafs biasing between a collet in said connector and said mandrel.

15. A cable connector according to claim 14, wherein said plurality of spring leafs and said mandrel are one-piece.

16. A cable connector according to claim 1, further comprising means for preventing said center conductor from making electrical contact with any grounded portions of said cable connector while connecting said coaxial cable end to said cable connector.

17. A cable connector according to claim 1, further comprising a thrust bearing disposed between said second plurality of rings and a wall of said cavity of said connector body.

18. A method for constructing a cable connector, comprising the steps of:

providing a connector body having a cavity therein;

providing a mandrel fitted inside said cavity for receiving a prepared coaxial cable end at an end of said connector body;

providing a first plurality of rings fitted between a portion of said mandrel and said connector body and a second plurality of rings fitted between said portion of said mandrel and said connector body, wherein said first plurality of rings and said second plurality of rings have wedge-shaped cross-sections, and wherein at least one of said first plurality of rings are of electrically conductive material;

interleaving said first plurality of rings and said second plurality of rings with one another so that adjacent surfaces of first plurality of rings and said second plurality of rings are in tapered relationship with each other;

providing a first sealing ring having a wedge-shaped cross section adjacent to one of said second plurality of rings and in tapered relationship with said one of said second plurality of rings, said first sealing ring being closer to said end of said connector body than said first and second pluralities of rings;

providing a second sealing ring adjacent said first sealing ring, said second sealing ring being closer to said end of said connector body than said first sealing ring, and said second sealing ring having a surface in tapered relationship with a surface of said first sealing ring; and driving said second sealing ring into wedging engagement with said first sealing ring, thereby driving said first sealing ring to drive said first and second pluralities of rings into wedging engagement with each other.

19. A method according to claim 18, wherein said first plurality of rings are gapped.

20. A method according to claim 18, further comprising the step of providing a segmented ring disposed between a shoulder of said mandrel and said first plurality of rings.

21. A method according to claim 20, wherein said segmented ring has a tapered surface only on a side adjacent one of said first plurality of rings.

22. A method according to claim 18, wherein a shoulder of said connector body has a tapered surface adjacent one of said first plurality of rings.

23. A method according to claim 18, wherein said sealing rings are plastic.

24. A method according to claim 18, further comprising the step of interposing a ground sheath of said coaxial cable between said portion of said mandrel and said first and second plurality of rings, so that said step of driving causes an interference fit among said connector body, said first and second pluralities of rings, said ground sheath, and said portion of said mandrel.

25. A method according to claim 24, further comprising the step of establishing a ground path connection between said ground sheath and said connector body via said interference fit among said connector body, said first and second pluralities of rings, and said ground sheath.

26. A method according to claim 18, further comprising the step of sealing an inside of said cable connector from an external environment when said prepared coaxial cable is inserted into said end of said connector body and said step of driving is completed.

27. A method according to claim 18, further comprising providing a plurality of spring leafs biasing between a collet in said connector and said mandrel.

28. A method according to claim 18, wherein said mandrel is of plastic and said plurality of spring leafs and said mandrel are one-piece.

29. A method according to claim 18, further comprising the step of preventing an exposed center conductor in said prepared cable end from making electrical contact with any grounded portions of said cable connector while connecting said coaxial cable end to said cable connector.

* * * * *